US006151833A

United States Patent [19]

Gmurowski et al.

[11] Patent Number: 6,151,833

[45] Date of Patent: Nov. 28, 2000

[54] EXTRUDED GUIDE FOR AUTOMOTIVE WINDOW REGULATOR ASSEMBLY

[75] Inventors: Waldemar Wawrzyniec Gmurowski, Sterling Heights; Jayprakash Uttamchand Raisoni, Rochester Hills, both of Mich.; Zinovy Tyves, Windsor, Canada

[73] Assignee: Delphi Technologies, Inc., Troy, Mich.

[21] Appl. No.: 09/258,777

[22] Filed: Feb. 26, 1999

[51] Int. Cl.[7] ..... E05F 11/48

[52] U.S. Cl. ..... 49/352

[58] Field of Search ..... 49/348, 349, 352, 49/502

[56] References Cited

U.S. PATENT DOCUMENTS

| | | | |
|---|---|---|---|
| 5,623,785 | 4/1997 | Mariel | 49/352 |
| 5,778,600 | 7/1998 | Chu | 49/352 |
| 5,782,038 | 7/1998 | Sponable et al. | 49/352 |
| 5,799,441 | 9/1998 | Shibata | 49/357 |

FOREIGN PATENT DOCUMENTS

| | | | |
|---|---|---|---|
| 2656428 | 6/1978 | Germany | 49/352 |
| 4064680 | 2/1992 | Japan | 49/352 |

*Primary Examiner*—Jerry Redman
*Attorney, Agent, or Firm*—Kathryn A. Marra

[57] ABSTRACT

A radially adjustable guide for a flexible line, a cable or tape, of an automotive regulator assembly is presented. The guide has a longitudinal channel disposed therein for receiving and guiding the flexible line, wherein the guide slidably captures the flexible line within the channel. The guide may be tubular. Alternatively, the guide may include a base portion; a pair of resilient arms extending upwardly from the base portion, defining the channel; and extensions extending inwardly from upper ends of the resilient arms for slidably capturing the flexible line in the channel. Additionally, the base portion of the guide may include a planar outer surface.

16 Claims, 3 Drawing Sheets

3,4,5
30
32
34
16
R
28
24
24
28
18
26
20
22
26
3,4,5
10
14
12
18
16A
24
24
16A
16
30

EXTRUDED GUIDE FOR AUTOMOTIVE WINDOW REGULATOR ASSEMBLY

TECHNICAL FIELD

The present invention relates to a guide for a regulator assembly and more particularly, to an extruded guide for an automotive regulator assembly.

BACKGROUND OF THE INVENTION

Automotive vehicles have windows that are opened and closed via regulator assemblies that are either manually operated or power controlled. Regulator assemblies can be tape driven or cable driven, each having many similar components between the two systems.

A typical tape drive regulator assembly comprises a plastic tape having perforations spaced along its length and has a generally rectangular shaped cross-sectional profile. The tape is attached to the base of the window, and the tape is slidably mounted in a channel track that is fixed to the inner doorframe. The tape is routed around various guides, e.g., metal pulleys, fixed molded sliders, or molded rollers, which are located in spaced relationship within the automotive door and attached to the inner doorframe. The tape is additionally coupled to a tape drive, which comprises a manually operated handle or electrically operated motor. The tape drive has teeth engaging the perforations of the tape, which push or pull the tape to slide the attached window up or down respectively.

A typical cable drive regulator assembly comprises a cylindrical shaped flexible cable passed around a winding device, e.g., a take-up drum or a cylindrical roller. The cable is attached to the base of the window, and slidably mounted in a conduit that is fixed to the inner doorframe. Similar to a tape drive assembly, the cable is routed around guides of the type discussed above, and coupled to a cable drive comprising a manually operated handle or electrically operated motor. The cable drive reversibly rotates the winding device to shorten or increase a free length of the flexible cable to raise or lower the window respectively.

Guides of either the tape or cable regulator assemblies are typically constructed of metal, e.g., pulleys, or are molded plastic components, e.g., fixed molded sliders. These types of metal or molded guides can not be adjusted once they are manufactured, and are designed to fit only one required radius per regulator assembly. Additionally molded guides require separate molds for each radius they are designed to fit. This inhibits the ability to consolidate parts, consequently increasing the number of parts that must be stocked for repair or assembly purposes.

The aforementioned guides have tracks or channels, which guide the cable or tape during operation of the regulator assembly. However, the guides do not retain the cable or tape securely within the channel until fully assembled to the doorframe. Therefore, the guides cannot be preassembled to their associated cable or tape. Consequently guides must be shipped separately when delivered to an original equipment manufacturer (OEM), and additional time is required for assembly of the guides to the cable or tape at the production line.

SUMMARY OF THE INVENTION

This invention offers advantages and alternatives over the prior art by providing an extruded guide for an automotive regulator assembly. Advantageously, the extruded guide is flexible and can be adjusted to fit a plurality of required radii of the regulator assemblies. This enhances the ability to consolidate parts, consequently decreasing the number of parts that must be stored for repair or assembly purposes. Additionally, the present invention securely retains the cable or tape within a channel of the guide before and after assembly. Therefore, the guides can be preassembled to their associated cable or tape before shipping to an OEM. This advantageously reduces assembly time of the entire regulator assembly at the production line.

These and other advantages are accomplished in a preferred form of the invention by providing a guide for receiving a flexible line of a regulator assembly having a longitudinal channel disposed therein. The guide is adjustable radially. Preferably the guide is formed of an extruded material. The extruded guide is considerably lighter and less bulky than the prior art molded or metal guides, and can be advantageously adjusted to fit radii within a variety of automotive regulator assemblies.

In an exemplary embodiment, the guide is tubular wherein the channel comprises an inside surface of the guide sized to receive the flexible line. In an alternative embodiment, the guide includes a base portion and a pair of resilient arms that extend upwardly from the base portion. The base and resilient arms define a generally rectangular or arcuate channel for receiving the flexible line. Preferably each arm includes an extension extending inwardly from upper distal ends of the arms for retaining the flexible line within the channel. The base portion may also have a planar outer surface for mounting to an inner doorframe.

BRIEF DESCRIPTION OF THE DRAWINGS

The present invention will now be described, by way of example only, with reference to the accompanying drawings in which.

DESCRIPTION OF THE PREFERRED EMBODIMENT

Figure 1:
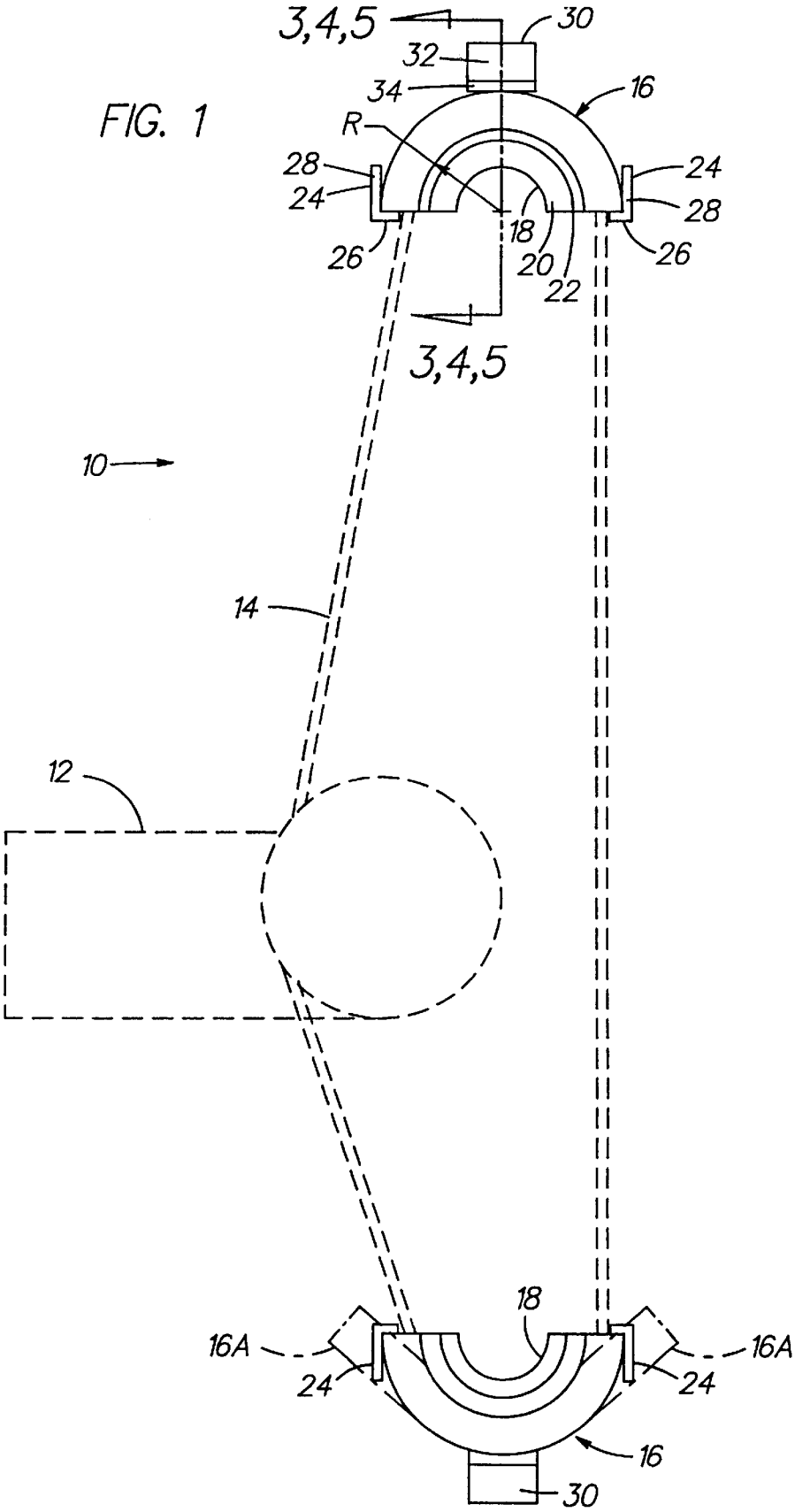
FIG. 1 is a diagrammatical view of an automotive regulator assembly of the present invention retaining a flexible line member.
Figure 2:
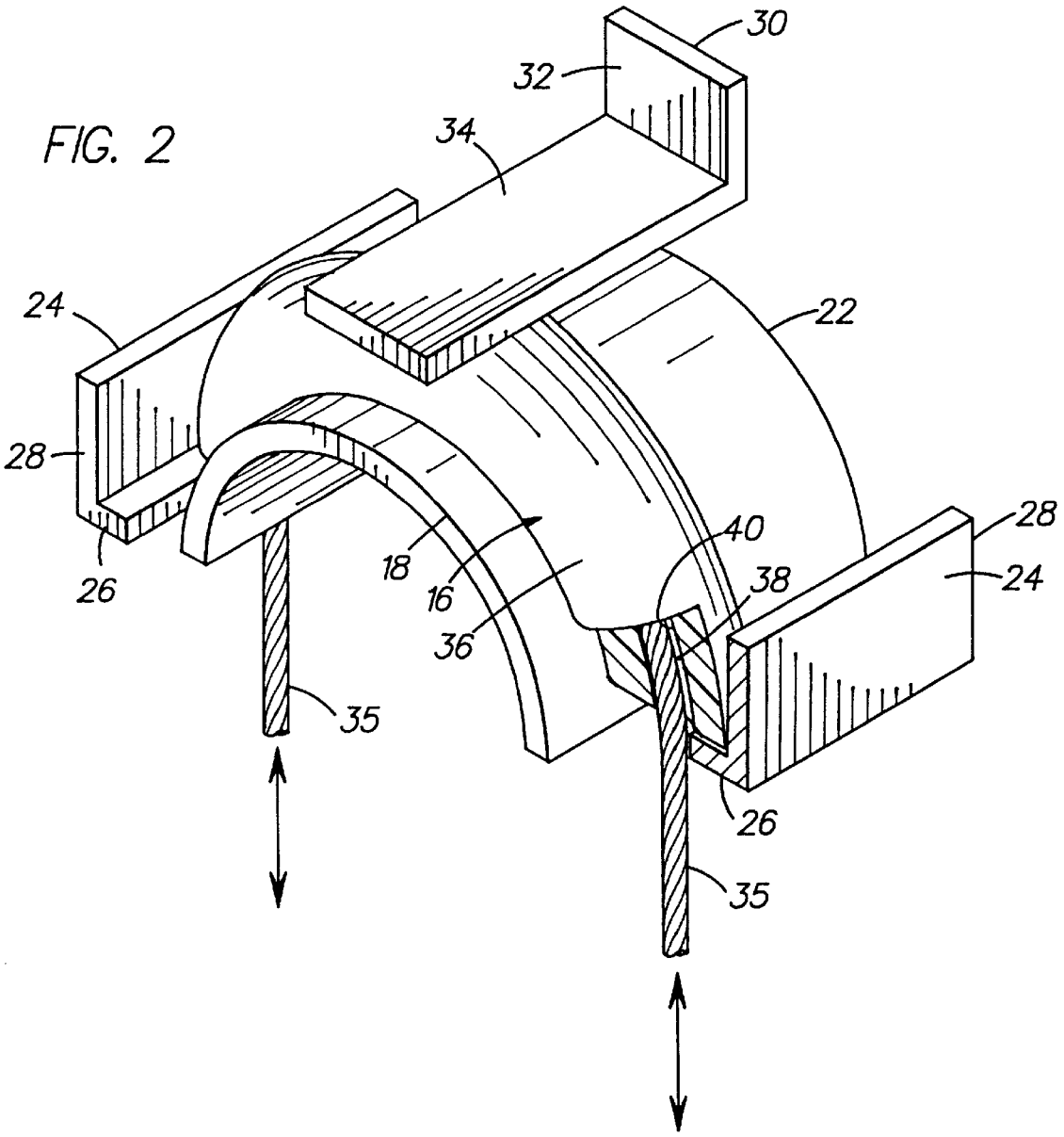
FIG. 2 is a perspective view of the top portion of the automotive regulator assembly of the present invention in partial section, showing an extruded guide retaining a cable embodiment of the flexible line member.

Referring to FIGS. 1 and 2, an automotive regulator assembly of the present invention is shown generally at 10. Regulator assembly 10 is mounted to an inner doorframe (not shown) of an automotive vehicle, and comprises a drive assembly 12, a flexible line member 14, a pair of extruded guides 16, arcuate mounting supports 18, and a plurality of mounting tabs 24 and 30. Flexible line member 14 is routed within the pair of extruded guides 16, which are located at opposing ends of regulator assembly 10. Extruded guides 16 radially adjust to fit the required radius R formed by supports 18.

Mounting supports 18 form generally an arch upon which extruded guides 16 rest. Supports 18 have an L-shaped cross section; whereby a vertical leg 20 of the support mounts to the inner door frame, and a horizontal leg 22 of the support extends outwardly from the door frame to provide a support for guide 16. Each guide 16 is supported at each end by a pair of L-shaped tabs 24. Tabs 24 are mounted edgewise against the inner door frame. Tab 24 has a horizontal leg 26 which provides support for each distal end of each guide 16, and a vertical leg 28 which restrains the ends of guide 16 against support 18 in its assembled position. Each guide 16 is further supported at its apex by L-shape tab 30. Tab 30 has a vertical leg 32 mounted to the inner door frame, and a horizontal leg 34 extending outwardly from the inner door frame that restrains the guide 16 against support 18 in its assembled position.

Extruded guides 16 are comprised of materials, e.g., acetal copolymer, formulated nylon, polymer material, and metallic material that are wear resistant and have a low coefficient of friction to allow for slideable movement of line member 14 during operation of regulator assembly 10. Extruded guides 16 can be manufactured substantially straight or with a preformed radius 16A (shown in phantom form) to facilitate radial adjustment to radius R of mounting support 18 during assembly.

Figure 5:
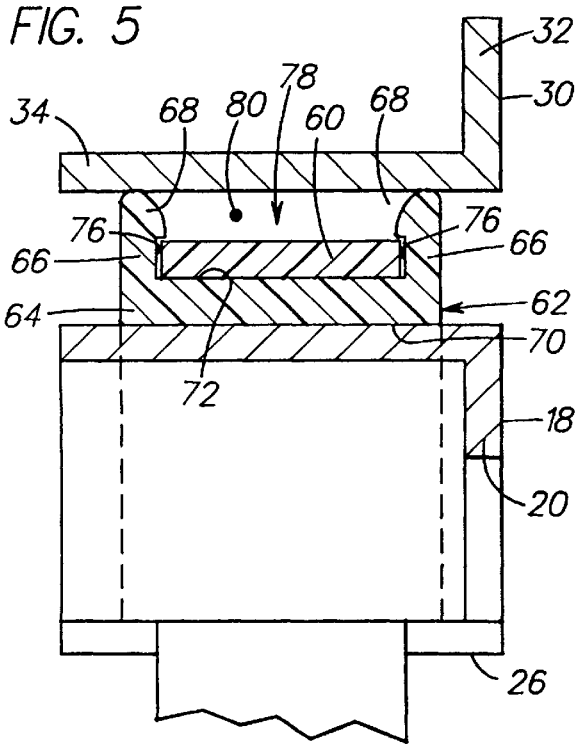
FIG. 5 is a cross-sectional view of another alternative embodiment of the extruded guide of the present invention, retaining a tape embodiment of the flexible line member.

Flexible line member 14 can be embodied as a cable 35 having a circular cross-sectional profile as shown in FIG. 2. Alternatively, flexible line member 14 can be embodied as a tape 60 having a rectangular cross-sectional profile as shown in FIG. 5.

Figure 3:
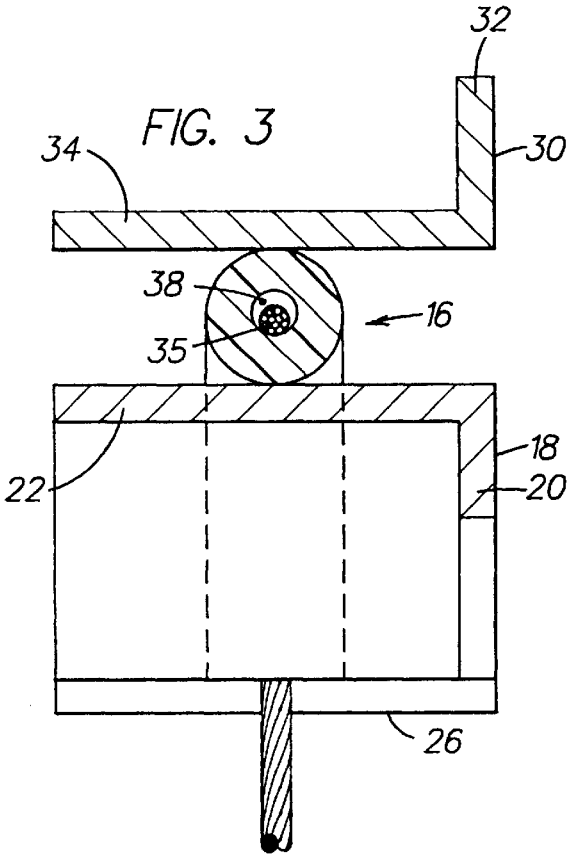
FIG. 3 is a cross-sectional view of the extruded guide of the resent invention retaining the cable.

Referring to FIG. 3, a cross-sectional view of an exemplary embodiment of the present invention is shown taken along the line 3, 4, 5 in FIG. 1, wherein flexible line member 14 comprises a cable 35 having a circular cross-sectional profile. In this embodiment, drive assembly 12 comprises a cable drive assembly having a winding device, e.g., a take-up drum or a cylindrical roller, which is attached to the cable 35, i.e., the cable embodiment of flexible line member 14. The cable drive assembly reversibly rotates the winding device to shorten or increase a free length of the flexible cable to raise or lower the window respectively.

In this exemplary embodiment of the present invention, extruded guides 16 have a tubular shape with a circular channel centrally disposed within. Channel 38 has a sufficient diameter to slidably capture cable 35, i.e., cable 35 is retained within channel 38 regardless of the orientation of the guide 16 and is permitted to freely slide through the channel 38 during operation of regulator assembly 10.

Guide 16 is shown in FIG. 3 mounted between arcuate support 18 and tab 30, wherein support 18 and tab 30 provide support for guide 16 during operation as discussed previously.

Figure 4:
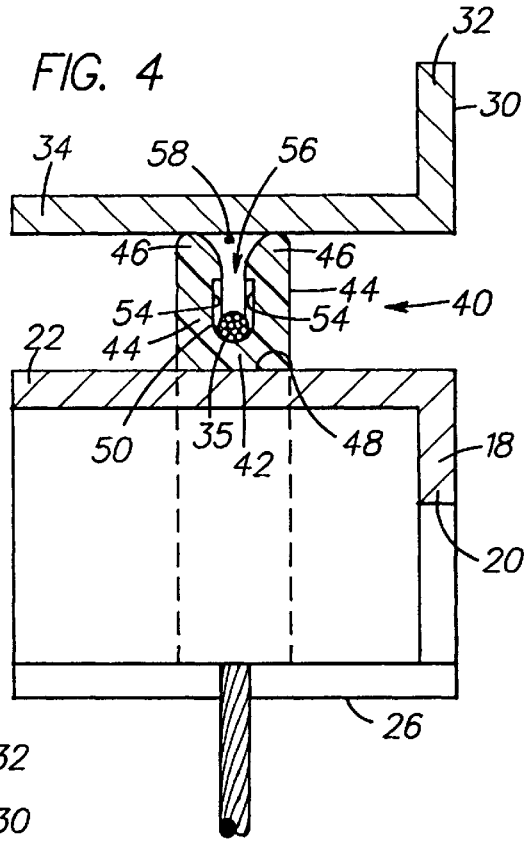
FIG. 4 is a cross-sectional view of an alternative embodiment of the extruded guide of the present invention retaining the cable.

Referring to FIG. 4, a cross-sectional view of another exemplary embodiment of the present invention is shown taken along the line 3, 4, 5 in FIG. 1. In this embodiment, extruded guide 40, having a generally "U" shaped cross-sectional profile, comprises a base 42, and a pair of resilient arms 44 extending upwardly therefrom. Base 42 has a flat outer surface 48 and an arcuate inner surface 50. Outer surface 48 rests against horizontal leg 22 of support 18 to prevent guide 40 from rotating during operation and possibly dislodging cable 35. Resilient arms 44 extend upwardly and substantially perpendicular from opposing distal ends of base 42. Inner surfaces 54 of arms 44 and inner surface 50 of base 42 define a generally "U" shaped channel 56. Channel 56 has a sufficient radius to retain cable 35 and permit the cable to freely slide through the guide 40 during operation. Resilient arms 44 have extensions 46, which extend inwardly from upper distal ends of arms 44 to form a gap 58 therebetween. The gap 58 has a width that is less than the diameter of cable 35. Cable 35 initially engages tapered outer surfaces of extensions 46 as it is inserted into channel 56 or is snapped into channel 56. Resilient arms 44 are urged outwardly by cable 35 until cable 35 passes through gap 58 with resilient arms 44 snapping back to their original position to slidably capture cable 35 within channel 56. That is, cable 35 is retained within channel 56 regardless of the orientation of the guide 40 and is permitted to freely slide through the channel 56 during operation of regulator assembly 10.

Guide 40 is shown in FIG. 4 mounted between arcuate support 18 and tab 30, wherein support 18 and tab 30 provide support for guide 40 during operation as discussed previously. Additionally, horizontal leg 34 of tab 30 covers gap 58 to provide a barrier to further prevent cable 35 from dislodging during operation.

Referring to FIG. 5, a cross-sectional view of an alternate exemplary embodiment of the present invention is shown taken along the line 3, 4, 5 in FIG. 1, wherein flexible line member 14 comprises a plastic tape 60 having a generally rectangular cross-sectional profile. In this embodiment drive assembly 12 comprises a tape drive assembly having teeth for engaging perforations of the plastic tape 60, i.e., the tape embodiment of flexible line member 14. The tape drive pushes or pulls the tape to slide an attached window (not shown) up or down respectively.

In accordance with this embodiment, cable guides 62, having a generally U shaped cross-sectional profile, comprises a rectangular shaped base 64, and a pair of resilient arms 66 extending upwardly therefrom. Base 64 has a flat outer surface 70 and a flat inner surface 72. Outer surface 70 rests against horizontal leg 22 of support 18 to prevent guide 62 from rotating during operation and possibly dislodging tape 60. Resilient arms 66 extend upwardly and substantially perpendicular from opposing distal ends of rectangular base 64. Inner surfaces 76 of arms 66 and inner surface 72 of base 64 define a generally rectangular channel 78 therein. Channel 78 has a sufficient width to retain tape 60 and permit the tape to freely slide through the guide 62 during operation. Resilient arms 66 have extensions 68, which extend inwardly from upper distal ends of arms 66 to form a gap 80 therebetween. Gap 80 has a width that is less than the width of tape 60. Tape 60 initially engages tapered outer surfaces of extensions 68 as it is inserted into channel 78 or is snapped into channel 78. Resilient arms 66 are urged outwardly by tape 60 to pass until tape 60 passes through gap 80 with resilient arms 66 snapping back to their original position to slidably capture tape 60 within channel 78. That is, tape 60 is retained within channel 78 regardless of the orientation of the guide 62 and is permitted to freely slide through the channel 78 during operation of regulator assembly 10.

Guide 62 is shown in FIG. 5 mounted between arcuate support 18 and tab 30, wherein support 18 and tab 30 provide support for guide 62 during operation as discussed previously. Additionally horizontal leg 34 of tab 30 covers gap 80 to provide a barrier to further prevent tape 60 from dislodging during operation.

The extruded guide 16 of the present invention has a shape, which slidably captures the cable 35 or tape 60 within its associated channel 38, 56 or 78 before and after assembly. This feature advantageously allows guide 16 to be pre-assembled to cable 35 or tape 60 to form a subassembly of regulator assembly 10. Additionally the extruded guide 16 is flexible whereby it can be adjusted to fit a plurality of radii, e.g., formed from different embodiments of support 18, of regulator assembly 10. While exemplary embodiments apply to window regulator assemblies, one skilled in the art would recognize that the invention can apply to other applications as well, e.g., sliding doors, sun roofs, lift gates and garage door openers.

It will be understood that a person skilled in the art may make modifications to the preferred embodiment shown herein within the scope and intent of the claims. While the present invention has been described as carried out in a specific embodiment thereof, it is not intended to be limited thereby, but is intended to cover the invention broadly within the scope and spirit of the claims.

What is claimed is:

1. A guide for receiving and guiding a flexible line of a regulator assembly, the guide having a channel disposed longitudinally therein, wherein the improvement of the guide comprises:

a guide that is adjustable radially; and an arcuate mounting support upon which the guide rests, the guide being supported by a plurality of tabs which are positioned to support and seat the guide against the arcuate mounting support, one of the plurality of tabs being disposed above the arcuate mounting support so that the guide is positioned between the one tab and the arcuate mounting support.

2. The guide of claim 1 wherein the guide is tubular.

3. A guide for receiving and guiding a flexible line of a regulator assembly, the guide having a channel disposed longitudinally therein, wherein the improvement of the guide comprises:

a guide that is adjustable radially, the guide including a base portion and a pair of resilient arms extending upwardly from the base portion, defining the channel for receiving and guiding the flexible line; and an arcuate mounting support upon which the guide rests.

4. The guide of claim 3 wherein each of the resilient arms include an extension extending inwardly from upper ends of the resilient arms for slidably capturing and retaining the flexible line in the channel.

5. The guide of claim 3 wherein the base portion includes a planar outer surface.

6. A guide for receiving and guiding a flexible line of a regulator assembly, the guide having a channel disposed longitudinally therein; wherein the improvement of the guide comprises:

a guide that slidably captures and retains the flexible line within the channel;

a pair of resilient arms extending upwardly from a base portion of the guide, defining the channel for receiving and guiding the flexible line, wherein each of the resilient arms includes an extension extending inwardly from upper ends of the resilient arms for the capturing and retaining of the flexible line within the channel.

7. The guide of claim 6 wherein the guide is tubular.

8. The guide of claim 6 wherein the base portion includes a planar outer surface.

9. The guide of claim 6 wherein the guide is adjustable radially.

10. A regulator assembly for moving a member; the regulator assembly comprising:

a flexible line engaging the member;

a drive assembly engaging the flexible line to move the member;

a guide for receiving and guiding the flexible line, the guide having a longitudinal channel disposed therein, wherein the guide is radially adjustable and slidably captures and retains the flexible line within the channel;

a pair of resilient arms extending upwardly from a base portion of the guide, defining the channel for receiving and guiding the flexible line.

11. The regulator assembly of claim 10 further including a mounting support having a mounting surface upon which the guide is radially adjusted thereto.

12. The regulator assembly of claim 11 further including a plurality of mounting tabs wherein the mounting tabs retain the guide against the mounting surface of the mounting support.

13. The regulator assembly of claim 10 wherein the guide is tubular.

14. The regulator assembly of claim 10 wherein each of the resilient arms include an extension extending inwardly from upper ends of the resilient arms for slidably capturing the flexible line in the channel.

15. The regulator assembly of claim 10 wherein the base portion includes a planar outer surface.

16. A regulator assembly for moving a member, the regulator assembly comprising:

a flexible line engaging the member;

a drive assembly engaging the flexible line to move the member; and a guide for receiving and guiding the flexible line, the guide having a longitudinal channel disposed therein, wherein the guide slidably captures and retains the flexible line within the channel, the guide resting upon an arcuate mounting support and being supported by a plurality of tabs which are positioned to support and seat the guide against the arcuate mounting support, one of the plurality of tabs being disposed above the arcuate mounting support so that the guide is positioned between the one tab and the arcuate mounting support.

* * * * *